US006217258B1

(12) United States Patent
Yamamoto et al.

(10) Patent No.: US 6,217,258 B1
(45) **Date of Patent: *Apr. 17, 2001**

(54) DUAL HOIST DERRICK SYSTEM FOR DEEP SEA DRILLING

(75) Inventors: Hiromitsu Yamamoto; Hiroyasu Ishiguro, both of Minato-ku (JP)

(73) Assignee: Japan Drilling Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/934,599

(22) Filed: Sep. 22, 1997

(30) Foreign Application Priority Data

Dec. 5, 1996 (JP) ..... 8-325443

(51) Int. Cl.[7] ..... E21B 15/02
(52) U.S. Cl. ..... 405/201; 175/5
(58) Field of Search ..... 405/195.1, 201, 405/224.2, 224.3, 224.4, 224, 224.1; 175/5, 6, 7, 8, 9, 10; 114/264, 265

(56) References Cited

U.S. PATENT DOCUMENTS 4,176,722 * 12/1979 Wetmore et al. ..... 175/7
4,208,158 * 6/1980 Davies et al. ..... 405/201
4,716,972 * 1/1988 Makinen et al. ..... 114/265
4,819,730 * 4/1989 Williford et al. ..... 175/7
4,850,439 * 7/1989 Lund ..... 175/52
5,150,987 * 9/1992 White et al. ..... 175/7
6,047,781 * 4/2000 Scott et al. ..... 175/5
6,056,071 * 5/2000 Scott et al. ..... 175/5
6,068,069 * 5/2000 Scott et al. ..... 175/5

* cited by examiner

*Primary Examiner*—David Bagnell
*Assistant Examiner*—Frederick L. Lagman
(74) *Attorney, Agent, or Firm*—Oliff & Berridge, PLC

(57) ABSTRACT

A dual hoist derrick system for deep sea drilling, capable of elevating a very long and massive heavy object involved in a drilling for deep sea, is provided with a normal drilling hoisting system and a heavy load hoisting system arranged on a single derrick in parallel. The derrick is mounted on a skid movable in a horizontal direction. The skid is provided with a cut broader than a blow-out prevention device, so that the skid may travel to a position of the blow-out prevention device to lift up the blow-out prevention device. The system contributes to speeding up in hoist speed of offshore drilling units for deep sea, reducing working hours and improvement in safety.

2 Claims, 10 Drawing Sheets

DUAL HOIST DERRICK SYSTEM FOR DEEP SEA DRILLING

BACKGROUND OF THE INVENTION

1. Field of the Invention

The present invention relates to an offshore drilling system for drilling wells under the bottom of the sea from the surface of the water in the deep sea, and also for a collection of natural resources such as manganese nodule, nickel, cobalt rich clast and the like on the bottom. The deep sea in the present invention referred to a sea the depth being not less than 1000 m.

2. Description of the Related Art

Hitherto, according to the conventional floating offshore drilling unit, an object of drilling is about 500 m or less in the depth of the water, a floating drilling marine structure is equipped with a fixed derrick, and lifting up and down of pipes are performed by a drilling unit in which a substructure (including a drill floor and a derrick) does not travel.

Under drilling in a great depth, a hoist for lifting up and down various pipes undergoes various different loads in compliance with individual works. The maximum load is the sum total of weight of a very long riser pipe due to a large depth, weight of a BOP (blow-out prevention device) and dynamic load caused by a vertical motion of the hull due to a wave, a wind and a wave motion. For example, in case of laout 2500 m of depth of the water, there will be produced a large load such as about 1000 tons in the total weight. Thus, it is indispensable to set up a hoist having a drawbar pull not less than 1000 tons.

On the other hand, it is considered that the suspension weight of drill strings, which will yield when a drilling is carried out, is about 400 tons, assuming that a drilling depth is 10,000 m. Therefore, in consideration of only the case of drilling, it is a difficult requirement to provide a 1000 tons class of hoist. Further, in the time of working of a lifting up-and-down pipe for drill strings frequently carried out, a device having a great drawbar pull involves such a problem that a hoisting speed is down on a physical basis in view of excessive pulley diameter, rope diameter, number of stages of rope , and weight, whereby the working efficiency will be extremely lowered.

In offshore oil drilling and scientific drilling, in view of special characteristics of work, in many cases, there is performed a coring (sampling of a geologic stratum) work or the like. This causes working hours for a lifting up-and-down pipe for drill strings to be increased. Thus, there is a need to reduce the whole working hours by effectively practicing those processes at higher speed.

Further, it is required to reduce a lead time in view of bad weather in a possibility of a typhoon or the like. Drill strings or the like inside a riser pipe is less in resistance and involves no fear of detention. Thus, the use of the drill strings or the like inside a riser pipe makes it possible to contribute to a higher speed as to a lifting up-and-down pipe at the time of passage through the riser pipe. In view of the foregoing, there is a need to make full use of this merit or advantage through high speed hoisting.

Hitherto, according to works of horizontal traveling and storage for a BOP on a drilling dredge or ship, it happens that a lifting-down load is not less than 150 tons. Consequently, there is a problem that this involves various dangers when the BOP is lifted up and horizontally traveled. Works on the drilling dredge involve various dangers such as a collision of the BOP with heavy objects due to pitching and/or rolling of the drilling dredge or due to the sway of the BOP, an accident of a fall to the sea, and works on a high scaffolding. It contributes to providing high efficiency of works, labor saving and improvement in safety that works of horizontal traveling and lifting up and down for the BOP system are mechanically performed.

SUMMARY OF THE INVENTION

In view of the foregoing, it is therefore an object of the present invention to provide a novel dual hoist derrick system for deep sea drilling, which contributes to speeding up in hoist speed of offshore drilling units for a deep sea, reducing working hours and improvement in safety.

The present invention has been developed to solve the problems mentioned above. According to the present invention, as technical means, there is disclosed a dual hoist derrick system for deep sea drilling characterized in that a hoisting system for drilling and a hoisting system for heavy loading are arranged on a single derrick in parallel. The present inventors named the novel dual hoist derrick system for deep sea drilling as a "dragon lift". In the dual hoist derrick system for deep sea drilling, said derrick is mounted on a skid beam capable of travelling in a horizontal direction so that said hoisting system for normal drilling and said hoisting system for heavy loading may travel to a working position. This feature makes it possible to optionally select a desired one of the hoisting systems promptly. Further, in the dual hoist derrick system for deep sea drilling, a setting place for a BOP is provided on a spider deck, and an upper substructure (including a drill floor), which is movable in a horizontal direction on the skid beam equipped with said derrick, is provided with a cut wider than a width of a BOP so that the BOP travels within the cut and said upper substructure can lift the BOP. This feature makes it possible to contribute to the stability of the ship in its entirety by lowering the height of the ship system so as to lower the center of gravity, and also to reduce the cost of the hull. It is acceptable that the BOP is lifted up directly by an oil cylinder, rack and pinion, and said hoisting system for heavy loading. This feature makes it possible to contribute to rationalization of a travelling device for the BOP and also to rationalization of works. Furthermore, in the dual hoist derrick system for deep sea drilling, a moon pool is formed with a round shape or an ellipse shape in its cross section, so that both the hoisting system for normal drilling and the hoisting system for heavy loading can be simultaneously used for works. This feature makes it possible to use both the hoisting systems at the same time, if necessary, thereby contributing to providing higher efficiency of works.

As described above, according to the present invention: a hoisting system for drilling and a hoisting system for heavy loading are arranged on a single derrick in parallel; the derrick is mounted on the upper substructure provided on the ship in such a way that the upper substructure is movable in a horizontal direction; the drilling hoisting system serves to perform a high speed lifting up and down; and the heavy load hoisting system deals with exclusively heavy load. These features make it possible to safely perform lifting up and down of heavy objects. Further, after reaching the drilling depth, the drilling hoisting system may insert casings promptly; lift up and down speeds of the drill strings may be increased; and during a drilling, it is easy to control load to be applied to bits mounted on the lower end of the drill strings. These make it possible to efficiently perform oil drilling and scientific drilling in great depth. Further, according to the present invention, for example, when a typhoon or the like comes, the drilling hoisting system may hoist the drilling strings to take measures to meet the situation.

Further, according to the present invention, when drilling workers perform working for a shift of the BOP within the ship, there is no need to perform works such as a wire furnishing, thereby reducing works for pulley change, re-suspension. In addition, the work in the drill floor is a main work. Thus, works on a high scaffolding are reduced and safety is improved. Furthermore, according to the present invention, the drill floor is formed lower than the top of the BOP, and the upper substructure skidding on the surface of the lower substructure in a horizontal direction is provided with a cut broader than the BOP. These features make it possible to lower the center of gravity of the drilling dredge.

Consequently, a rolling of the hull becomes little, and thus it is possible to expect a stable operation or work, thereby making it easy to perform the works in its entirety. Still further, according to the present invention, a moon pool is formed with a round shape or an ellipse shape in its cross section, so that both the hoisting system for drilling and the hoisting system for heavy loading can be simultaneously used for works. This feature makes it possible to use both the hoisting systems at the same time, thereby contributing to reduction of a large amount of working hours and providing higher efficiency of works in great depth of drilling.

DETAILED DESCRIPTION OF THE PREFERRED EMBODIMENTS

Hereinafter, there will be described embodiments of the present invention referring to the accompanying drawings.

Figure 1:
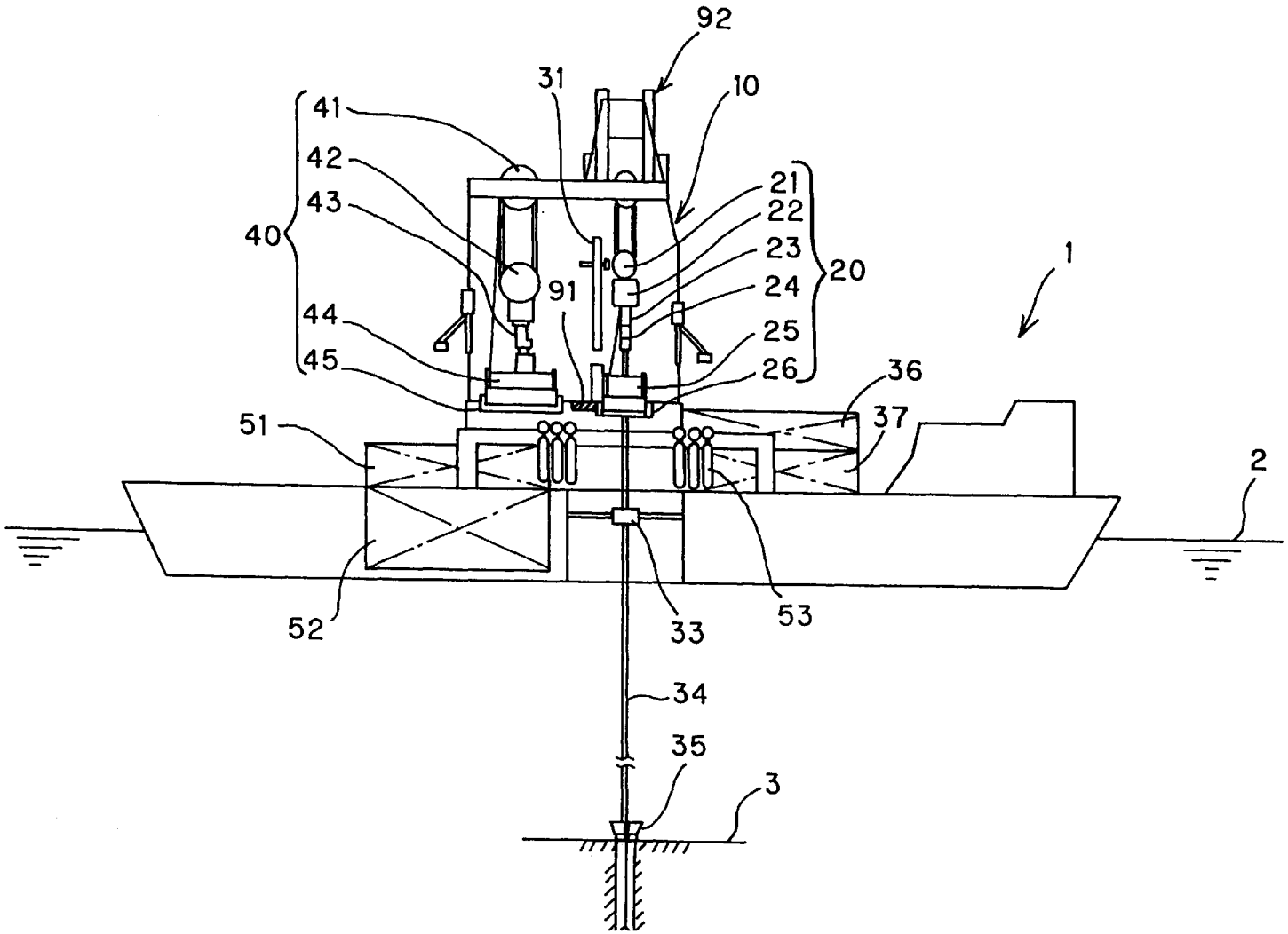
FIG. 1 is a side elevation of a drilling dredge according to an embodiment of the present invention.

FIG. 1 is a side elevation of a drilling dredge 1 according to an embodiment of the present invention. The drilling dredge 1 or ship floats in surface 2 of water. A derrick 10 set up on the ship 1 is equipped with both a hoisting system 20 for normal drilling and a hoisting system 40 for heavy loading. FIG. 1 shows a state in which a drill strings 34 extends from the drilling hoisting system 20 to a drill aperture on bottom 3 of the sea and further extends into a base 35 with a reentry guide cone.

The drilling hoisting system 20 comprises a travelling block 21 movable in a vertical direction, a top drive system 22 for providing a rotation for the drill strings, a hook block 23, a hoisting accessary system 24 composed of an elevator, link and the like, a hoisting drum, i.e. a drum 25 of the drilling hoisting system, and a rotary table 26. Those elements are coupled with each other in series in the named order to suspend the drill strings 34. The drill strings 34 are stored in a drill string storage space 37 called as a pipe rack, and are handled with a drill floor outside drill strings handling system 36. Further, the drill strings 34 are lifted up by a drill floor inside drill strings handling system 31, coupled with the top of the drill strings 34 stored in such a fashion that the strings are suspended perpendicularly with respect to a setback 91, and then descends through a pipe centering system 33. The drilling hoisting system 20 serves as a high speed pipe lift up-and-down system.

The derrick 10 is equipped with the drilling hoisting system 20 and the heavy load hoisting system 40 as well in such a relation that both the systems are arranged in parallel to one another. The heavy loading hoisting system 40 comprises an upper crown block 41, a vertical motion travelling block 42, a hook block 43, a hoist drum 44 of a riser winch and a rotary table 45 on which the hoist drum 44 is put. The heavy load hoisting system 40 serves to suspend heavy load. In such a heavy load hoisting system 40, many pulleys are used to put a wire rope round the pulleys on a multiple stage basis. The heavy load hoisting system 40 serves as a low speed and great load of hoisting system. On the ship, there are provided a riser storage space 52 referred to as a riser rack, a drill floor outside handling system 51 and a riser tensioner 53.

Figure 2:
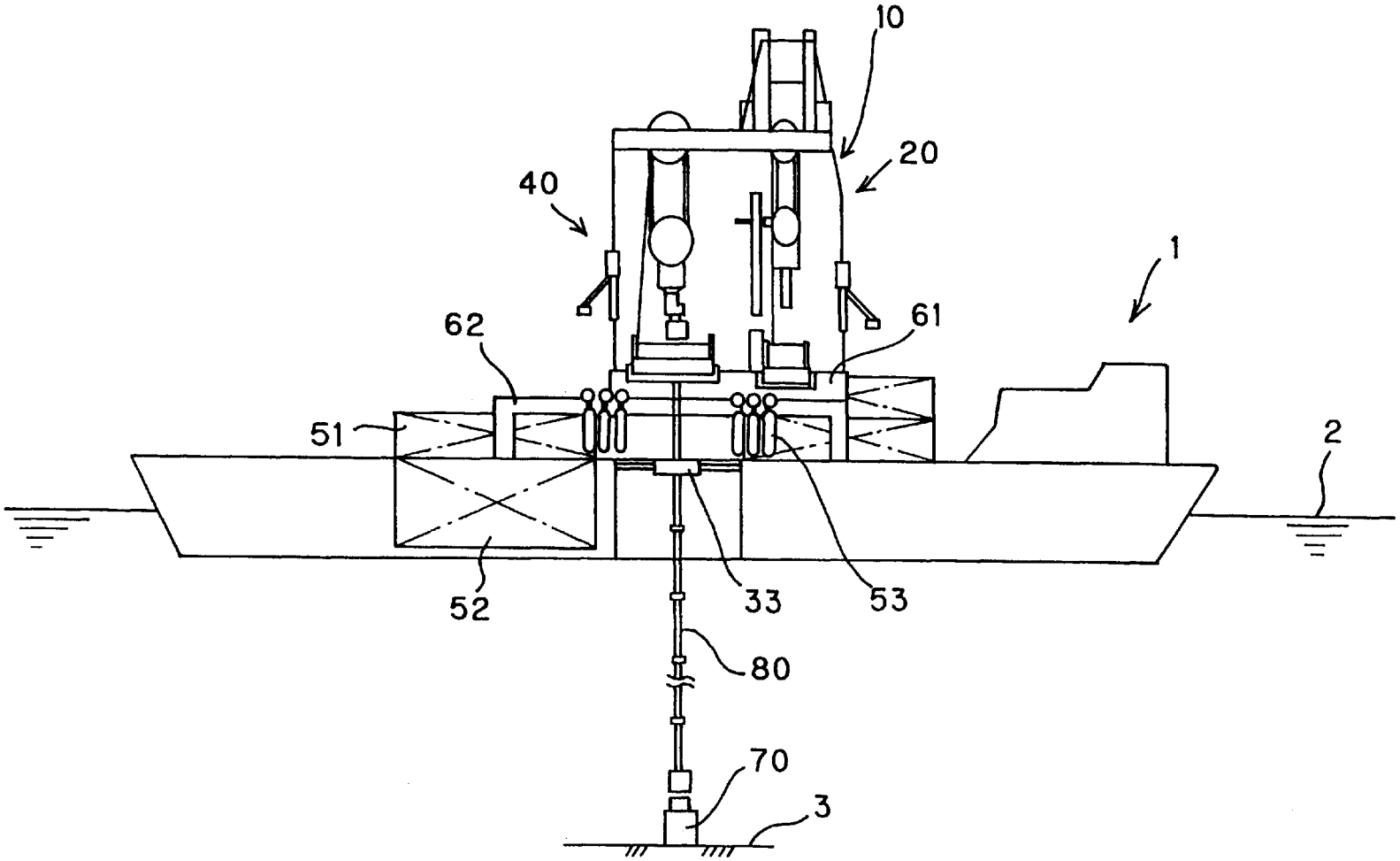
FIG. 2 is a side elevation of a drilling dredge according to an embodiment of the present invention.

FIG. 2 is, similar to FIG. 1, a side elevation of a drilling dredge 1. A different point from FIG. 1 is that the derrick 10 horizontally travels, and the heavy load hoisting system 40 suspends a BOP 70 and a riser pipe 80 up to the place of the bottom 3 of the sea. The derrick 10 is put on a drill floor of an upper substructure 61. A movement of the upper substructure 61 on a skidding floor of a lower substructure 62 makes it possible to change a position of the derrick 10.

Figure 3:
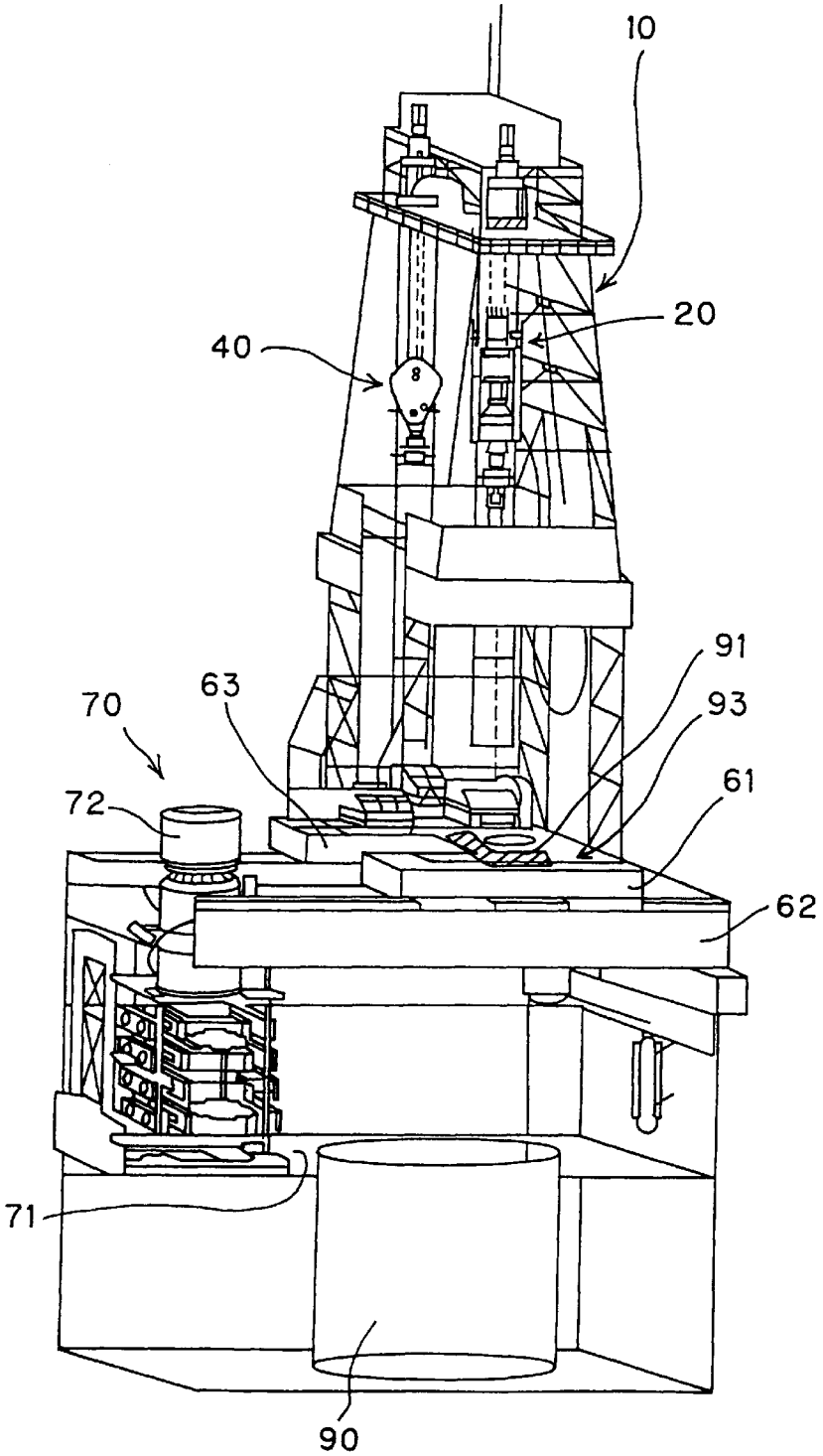
FIG. 3 is a perspective view showing a state in which a BOP is loaded.

FIG. 3 is a perspective view showing a state in which a BOP 70 is loaded on a spider deck 71, and top 72 of the BOP 70 projects over the upper substructure 61 and a drill floor 93. In other words, the drill floor 93 is set up at the position lower than the top of the BOP 70. And each of the upper substructure 61 movable on a surface of the lower substructure 62 in a horizontal direction and the drill floor 93 is provided with a cut 63 wider than the BOP 70.

Figure 4:
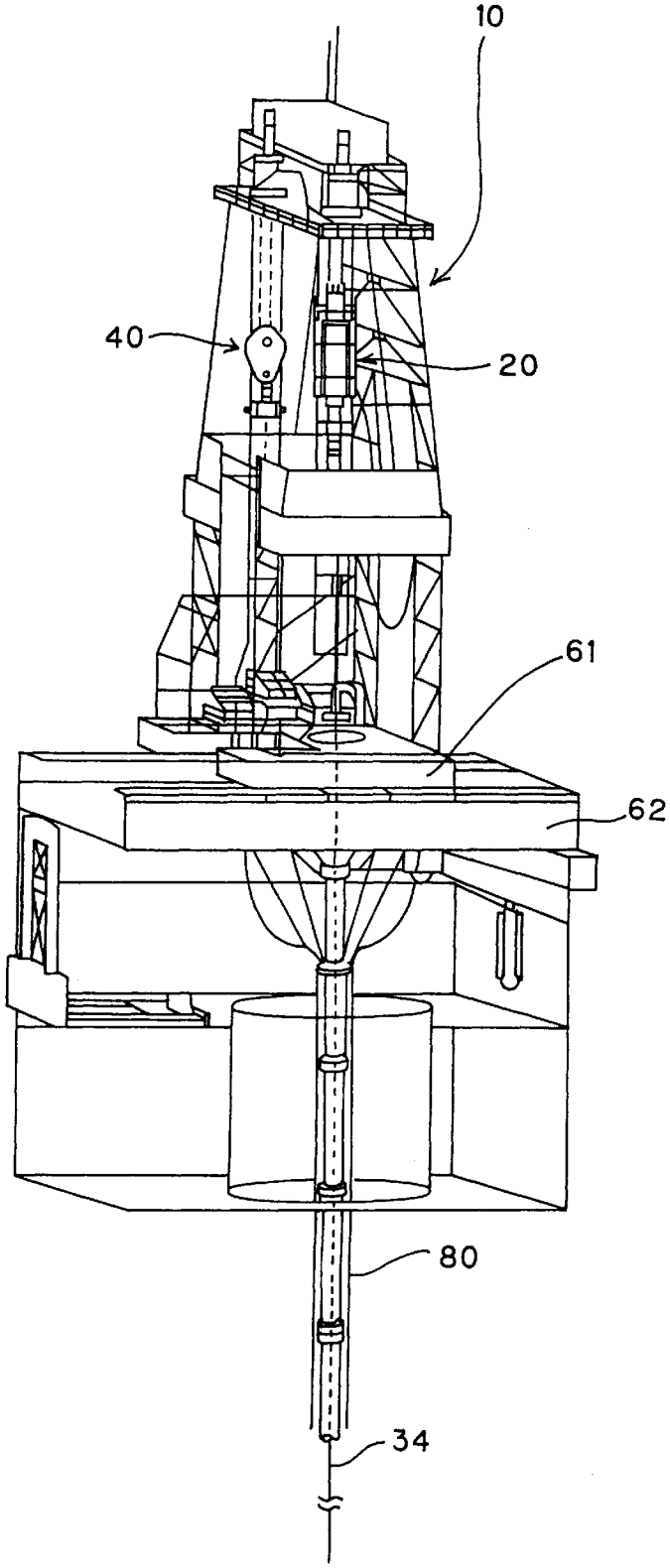
FIG. 4 is an explanatory view useful for understanding a working state of a hoisting system for drilling.

FIG. 4 is an explanatory view useful for understanding a working state of the drilling hoisting system 20 in which a riser pipe 80 is suspended into water, and the drill strings 34 are suspended passing through the riser pipe 80.

Figure 5:
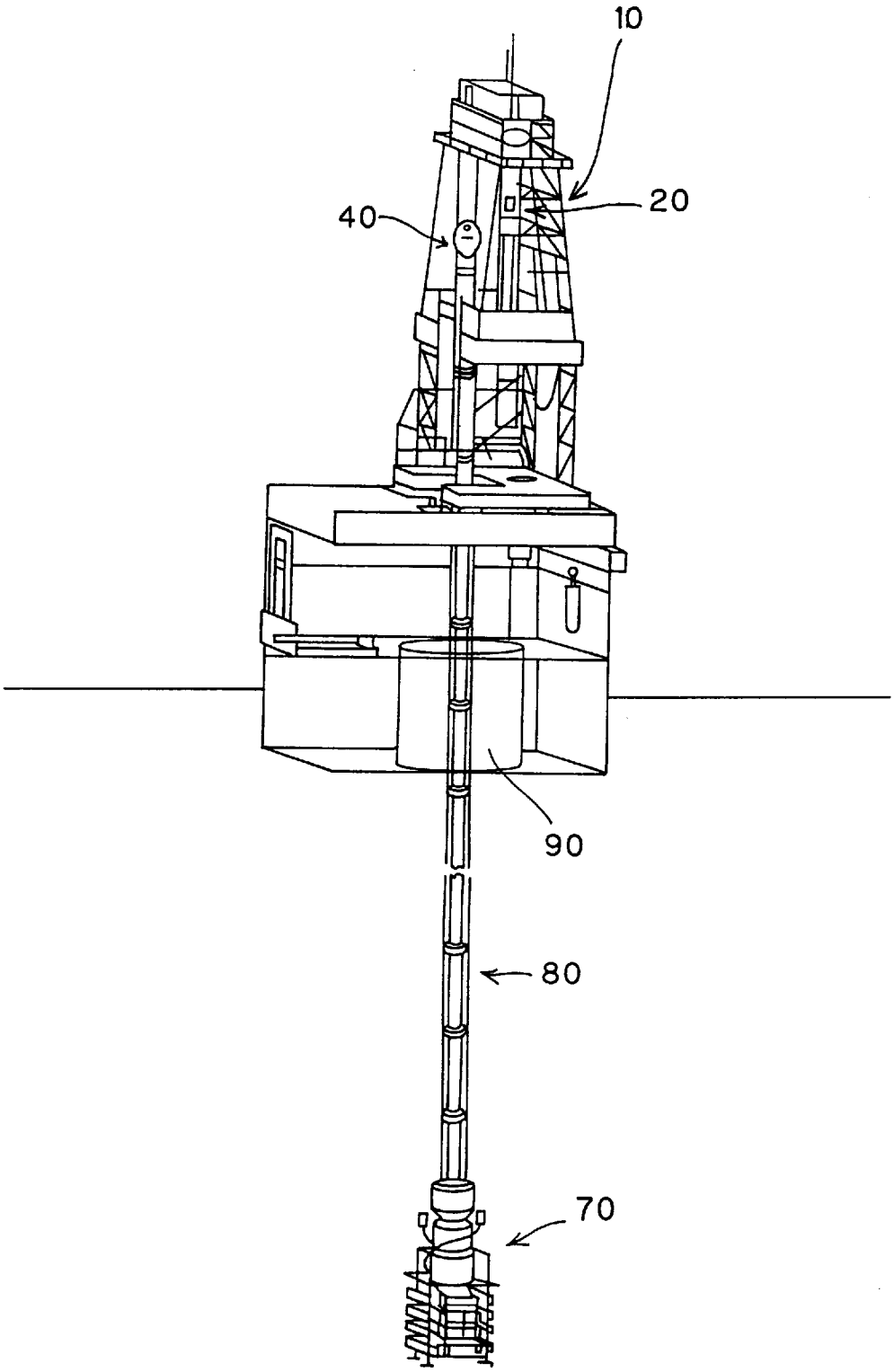
FIG. 5 is an explanatory view useful for understanding a working state of a hoisting system for heavy loading.
Figure 6:
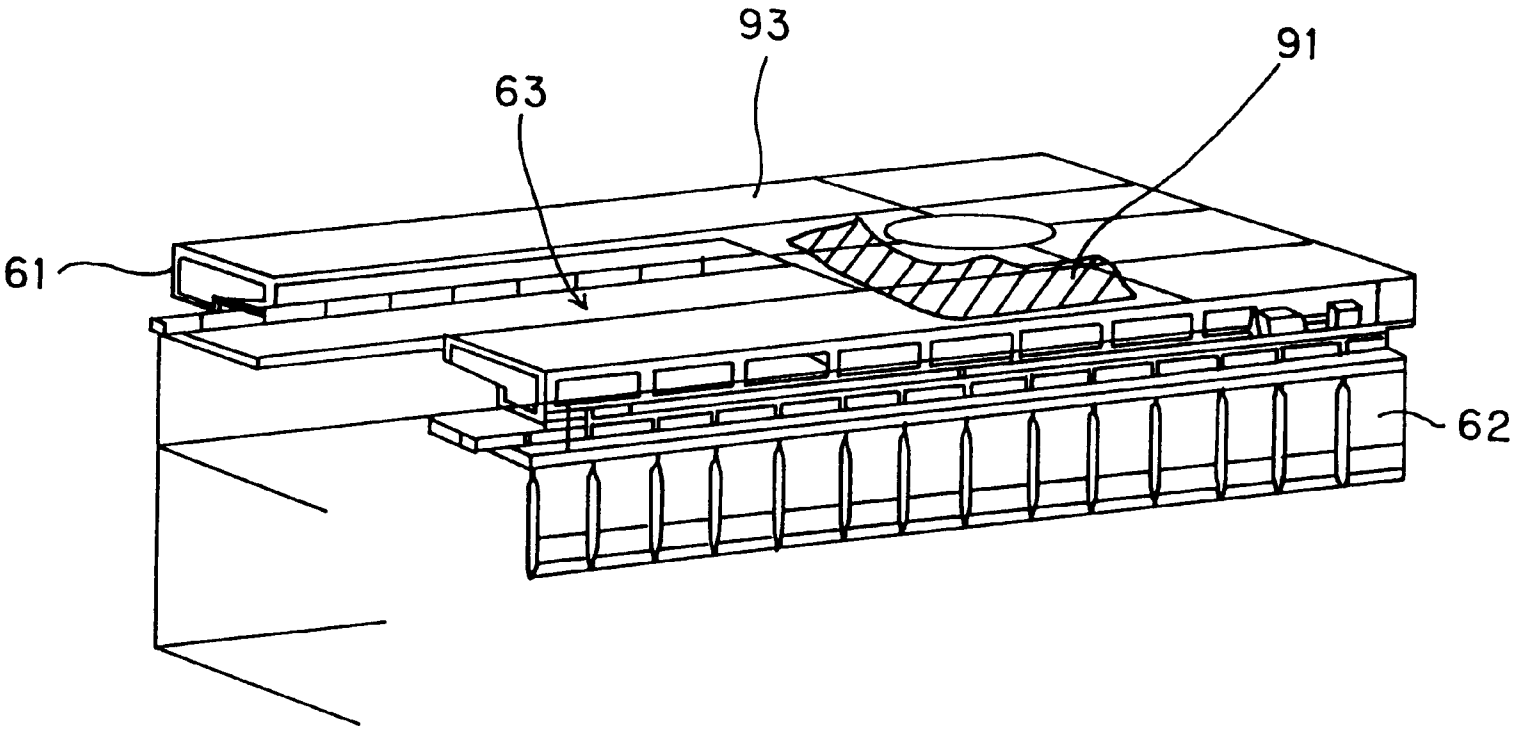
FIG. 6 is a perspective view showing a relation between a skid beam and an upper substructure.
Figure 7:
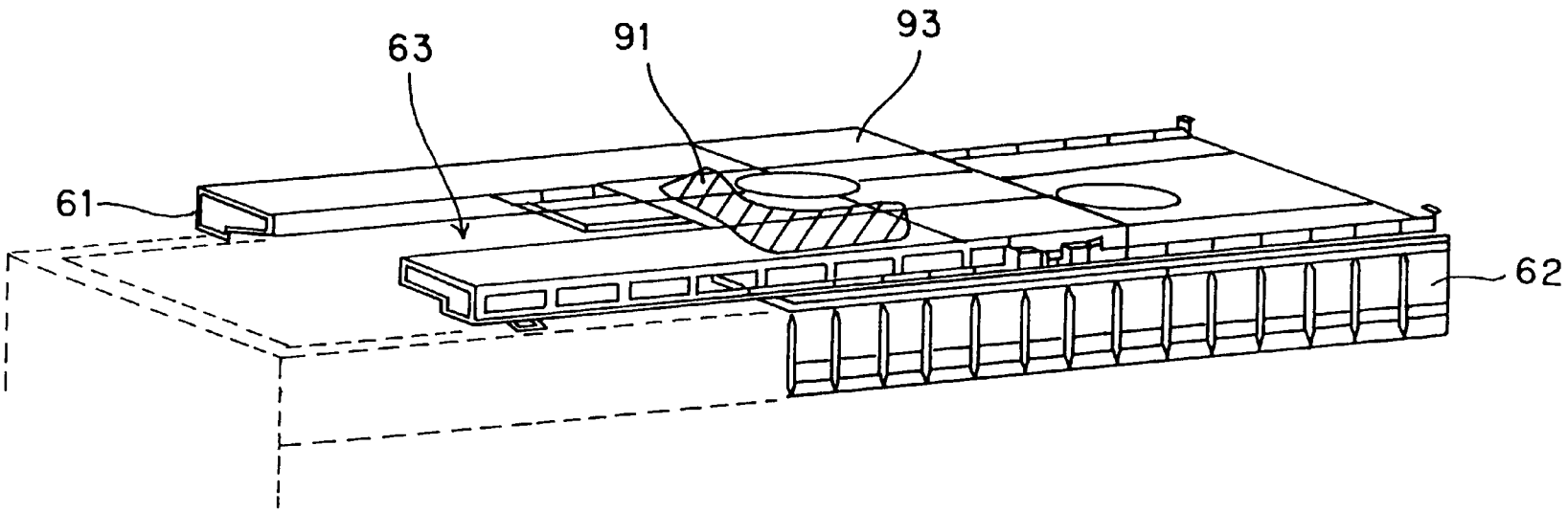
FIG. 7 is a perspective view showing a relation between a skid beam and an upper substructure.

FIG. 5 is an explanatory view useful for understanding a working state of the heavy load hoisting system 40 in which the BOP 70 and the riser pipe 80 are suspended. Each of FIGS. 6 and 7 is a perspective view showing a relation between the upper substructure 61 and the lower substructure 62. The upper substructure 61 is provided with a drill floor 93. The upper substructure 61 skids on the surface of the lower substructure 62. The upper substructure 61 is provided with the cut 63 wider than the BOP 70, in the front of a forward direction, and is so arranged that when the upper substructure 61 skids backward, the BOP 70 is accommodated in the cut 63.

Figure 8:
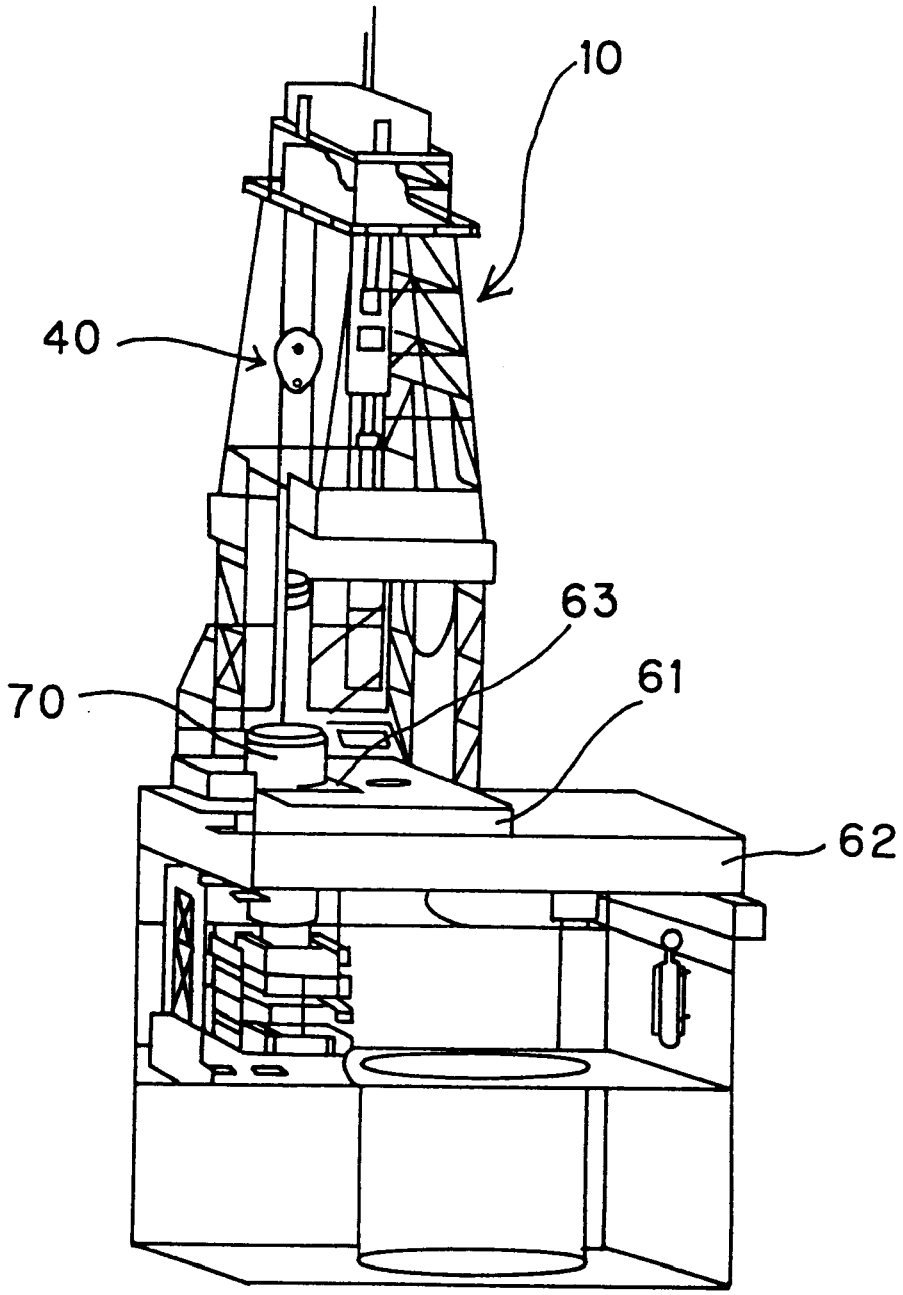
FIG. 8 is an explanatory view useful for understanding a state in which an upper substructure travels to lift up a BOP.

FIG. 8 is an explanatory view useful for understanding a state in which the upper substructure 61 travels to lift up the BOP 70, and the heavy load hoisting system 40 lifts up the BOP 70 accommodated in the cut 63. In this manner, according to the present invention, it is possible to perform works promptly, safely and efficiently, since the heavy load hoisting system 40 is used to lift up and down the BOP 70, without the use of the revolving crane in the drilling dredge for the purpose of a movement of the BOP.

Figure 9:
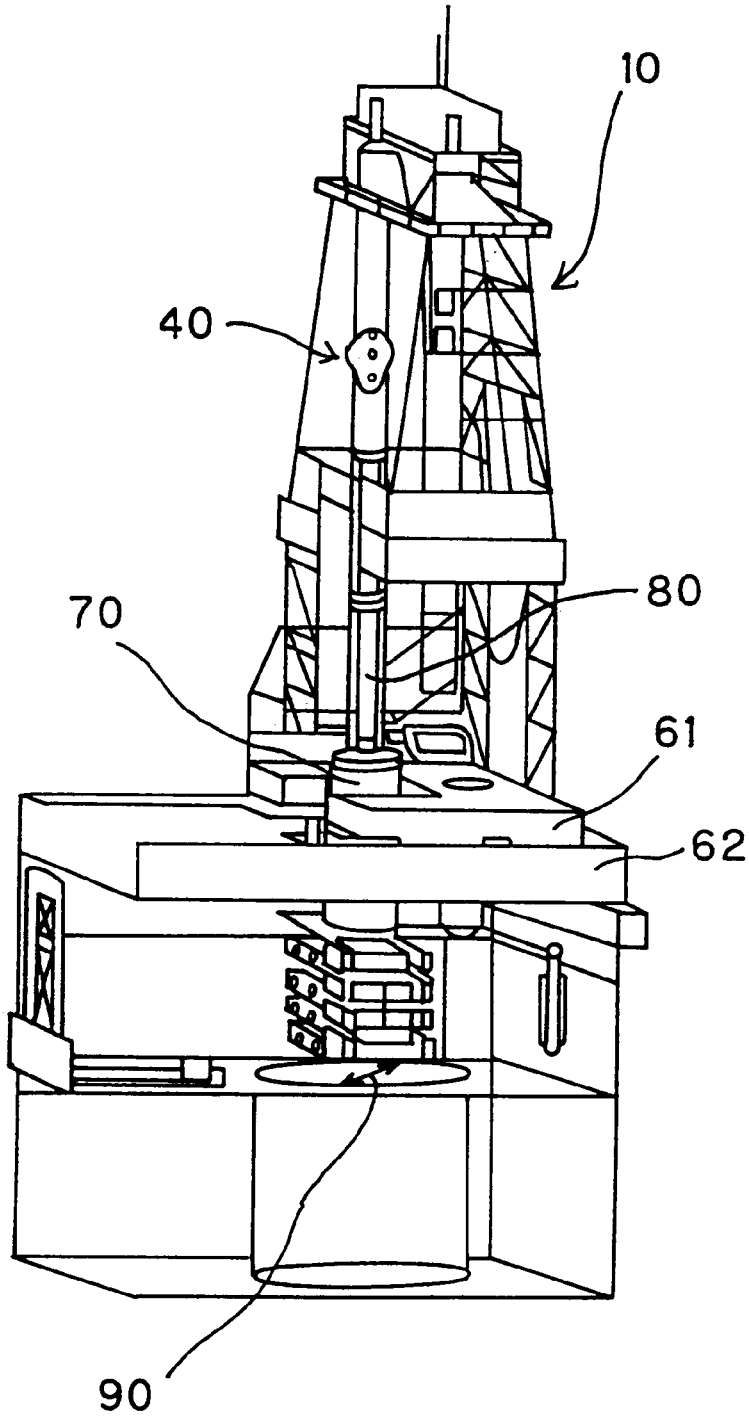
FIG. 9 is an explanatory view useful for understanding a state in which a BOP is moved to a moon pool.

FIG. 9 is an explanatory view useful for understanding a state in which the upper substructure 61 terminates in skid and the heavy load hoisting system 40 lifts up the riser pipe on which the BOP is mounted, and the lifted up BOP 70 is moved to a moon pool 90.

Figure 10:
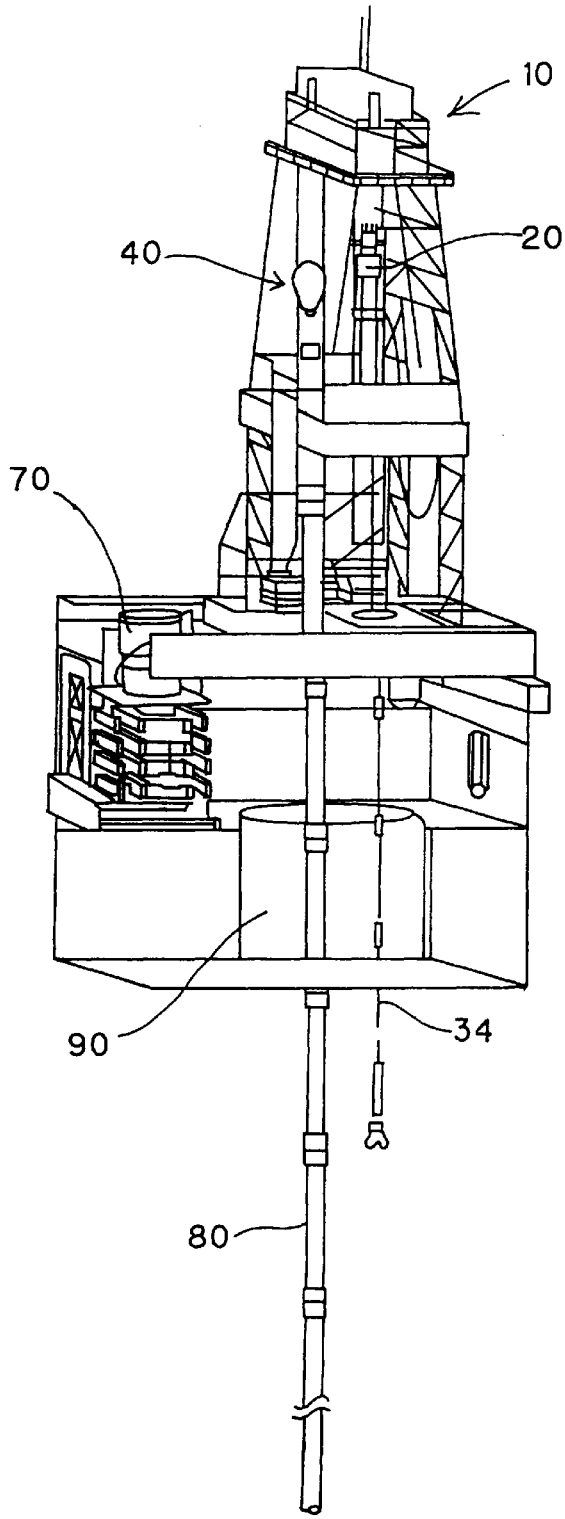
FIG. 10 is an explanatory view useful for understanding a state in which both the hoisting system for drilling and the hoisting system for heavy loading are simultaneously operated.

FIG. 10 is a n explanatory view useful for understanding a state in which both the drilling hoisting system 20 and the heavy load hoisting system 40 are simultaneously operated. The drilling hoisting system 20 suspends the drill strings 34, and the heavy load hoisting system 40 suspends the riser pipe 80. For the reason, the moon pool 90 is formed with a round shape or an ellipse shape in its cross section, so that both the hoisting system for drilling and the hoisting system for heavy loading can simultaneously pass through.

What is claimed is:

1. A dual hoist derrick system for drilling of deep sea having a depth not less than 1000 m, the system comprising:

a single derrick;

a first hoisting system for normal drilling by raising and lowering of drill strings;

a second hoisting system for heavy loading by raising and lowering of a riser pipe and a blow-out prevention device, the first hoisting system and the second hoisting system being provided on the single derrick in parallel; and a skid beam capable of traveling in a horizontal direction, wherein said derrick is mounted on said skid beam so that said first hoisting derrick system for normal drilling and said second hoisting derrick system for heavy loading may travel to a working position.

2. A dual hoist derrick system for deep sea drilling according to claim 1, wherein a setting place for a blow-out prevention device is provided on a spider deck, and an upper substructure, which is movable in a horizontal direction on the skid beam equipped with said derrick, is provided with a cut wider than a width of a blow-out prevention device so that the blow-out prevention device travels within the cut and said upper substructure can lift the blow-out prevention device.

* * * * *